United States Patent [19]

Motzer et al.

[11] Patent Number: 4,461,121

[45] Date of Patent: Jul. 24, 1984

[54] PROGRAM-CONTROLLED GRINDING MACHINE, PARTICULARLY FOR SHARPENING OF ROTATABLE CUTTING TOOLS

[75] Inventors: Willi Motzer, Tübingen; Horst Bräuning, Wankheim, both of Fed. Rep. of Germany

[73] Assignee: Montanwerke Walter GmbH, Tübingen, Fed. Rep. of Germany

[21] Appl. No.: 382,929

[22] Filed: May 28, 1982

[30] Foreign Application Priority Data

Aug. 25, 1981 [DE] Fed. Rep. of Germany ..... 3133488

[51] Int. Cl.[3] ..... B24B 3/06

[52] U.S. Cl. ..... 51/3; 51/96; 51/165.71; 51/166 T; 51/225

[58] Field of Search ..... 51/3, 96, 165.71, 165 TP, 51/165.72, 166 T, 225

[56] References Cited

U.S. PATENT DOCUMENTS

| | | | |
|---|---|---|---|
| 1,993,418 | 3/1935 | Smyser | 51/166 T |
| 2,887,828 | 5/1959 | Martin | 51/96 |
| 3,125,932 | 3/1964 | Katona | 51/3 |
| 3,488,886 | 1/1970 | Braum | 51/3 |
| 3,680,263 | 8/1972 | Johnson | 51/96 |
| 3,719,459 | 3/1973 | Southland | 51/96 |
| 4,115,956 | 9/1978 | Huffmann | 51/96 |

*Primary Examiner*—Harold D. Whitehead

*Attorney, Agent, or Firm*—Frishauf, Holtz, Goodman & Woodward

[57] ABSTRACT

To permit cutting of rotatable machine tools, or sharpening of cutting edges therefrom, for example boring tools, drills, milling cutters and the like, a grinding head has positioned thereon two spindles which carry at least three grinding wheels; one of the spindles (41) carries two grinding wheels (43, 44) and is rotatable about a horizontal axis of rotation (42). The other spindle (37) carries a grinding wheel (35) and may carry a second one at the other end (35*a*) and is positioned for rotation in an essentially vertical plane. The spindles can be tilted out of position in their normal rest planes by program-controlled (47) motors, such as stepping motors or servo motors. The workpiece tool (13, 50) is held in a tool carrier (7) which is rotatable with respect to the grinding head, and movable with respect thereto by cross slide positioning means (4, 5; 2, 19). The machine tool provides six program-controlled movements: three translatory movements along the axes (X, Y, Z), the Y axis being a vertical movement of a post (20) carrying the grinding head; and three axis of tilt or rocking movement (A, B, C) for relative adjustment of the positioning of the grinding heads with respect to the tool.

12 Claims, 8 Drawing Figures

Fig. 7
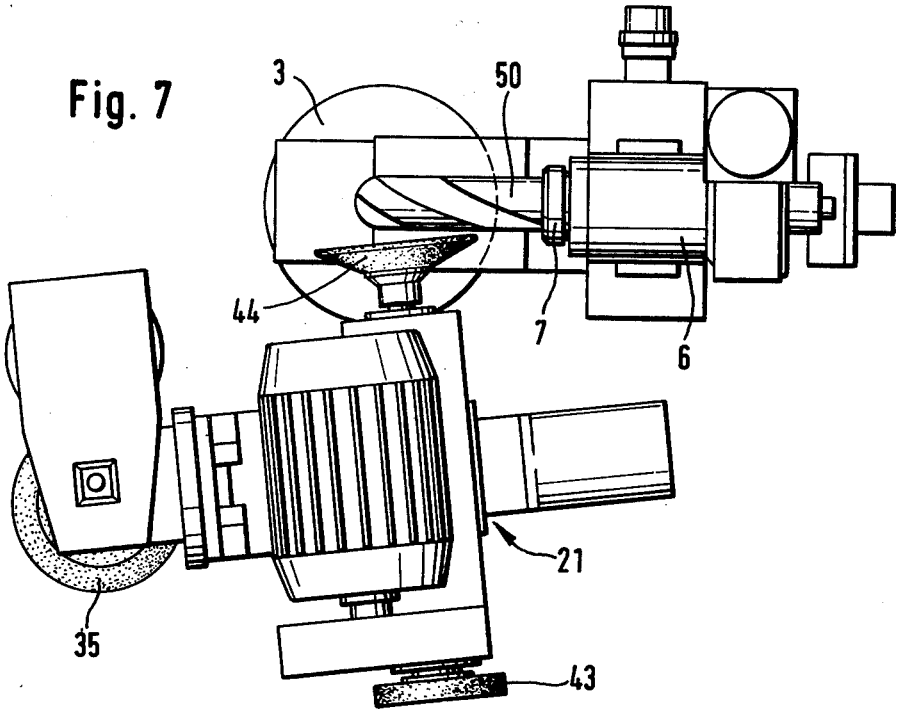
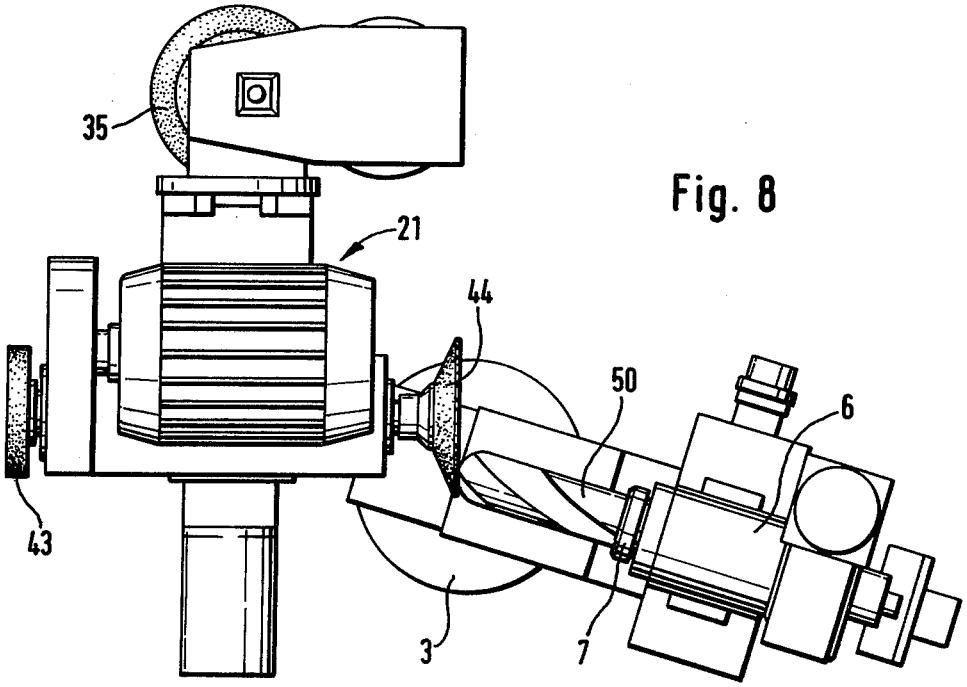
Fig. 8

PROGRAM-CONTROLLED GRINDING MACHINE, PARTICULARLY FOR SHARPENING OF ROTATABLE CUTTING TOOLS

The present invention relates to a program-controlled machine tool grinding machine, and more particularly to a machine which is suitable for making and sharpening of rotatable cutting tools, such as drills, boring tools, milling cutters, and the like.

BACKGROUND

Grinding tools to grind essentially cylindrical or other rotatable cutting tools have been previously proposed. One such grinding machine is described in U.S. Pat. No. 3,680,263, Johnson, in which a grinding head is provided carrying a grinding wheel or grinding disk. The machine is suitable for grinding the end cutting teeth in tools of the ball nose end mill types, and tools which have spiral flutes and end cutting teeth, which are jointed to the spiral flutes. The grinding head is fixed with respect to a vertical axis, that is, is not rotatable with respect thereto. The took, which is clamped in a suitable receiving spindle or chuck, is rotated by rotating the chuck. During the grinding operation, the cutting edges of the end faces, that is, of the end cutting teeth, can be ground, starting from the axis of the cutting tool and progressing towards the circumference of the workpiece or cutting tool.

This machine is not capable of also grinding the spiral grooves or flutes located at the circumference of the shank of the cutting tool; likewise, such grooves or flutes cannot be made in a solid cylindrical cutter which has end cutting teeth. It is thus not possible to prepare, by grinding, flutes or grooves to remove cutting chips by grinding the flutes or grooves, spirally, in a solid shank element. It is also not possible to grind a clearance angle on the cylindrical cutting surfaces, and thereafter to grind the edges in the radial region of the tools. In order to provide for complete sharpening of a milling cutter which has spiral flutes as well as end teeth, however, or to prepare spiral flutes, it is necessary to utilize various types of grinding machines, which requires repetitive clamping of the workpiece in various machines and subsequent careful alignment of the workpiece or cutting tool in the respective grinding machines.

U.S. Pat. No. 4,115,956 describes a cutting machine which is particularly adapted to grind cutting edges and clearance surfaces on cutting tools such as end mills and similar cutters. The machine is numerically controlled, that is, is program-controlled, and utilizes a cutter head which is rotatable about a vertical axis in order to increase the utility of the machine and to permit a larger number of cutting surfaces to be ground than prior machines. The increased versatility of the machine, however, requires complex construction thereof. All the grinding operations are carried out with a single grinding disk or grinding wheel which is located on the grinding head. Consequently, the positioning movement for the grinding head and for the single grinding disk thereon becomes complex; it is still very difficult to provide for grinding of a spirally grooved end and boring mill cutter at all cutting surfaces thereof.

The machine requires a cutting disk of complex shape, since various surfaces on the milling cutter to be ground have to be sharpened by the same cutter disk. Use of such a special cutter disk is expensive and not economical, both with respect to wear on the cutter disk as well as to its adjustment and positioning in the machine relative to the milling cutter which is to be sharpened. It is thus not possible to use standard cutter disks or cutting wheels which are stock articles of trade in the machine tool field.

It has previously been proposed to construct a numerically controlled machine tool sharpening grinder in which a grinding head has two grinding disks secured thereto, located in fixed distance, and fixed relative angular position opposite each other, which permit subdividing the grinding operations. A machine of this type, particularly designed for grinding of the cutting surfaces of end mills, does not permit, however, grinding all the cutting surfaces of complex cutter tools which cut at the end surfaces as well as the circumferential radial surfaces, unless a machine of this type can be constructed to operate about eight differently positioned axes of rotation or of reference. Construction of a machine with that many reference axes is extremely expensive and complex.

THE INVENTION

It is an object to provide a program-controlled machine tool which permits grinding of end milling cutting surfaces, as well as radial or circumferential cutting surfaces, for example alongside spiral grooves, that is, to permit grinding-in and/or sharpening the cutting surfaces of boring tools, end mills, drills, and the like, in which the grinding sequences can be controlled for automatic, programmed runs, and which are simple in construction and can be easily programmed for different machine tools.

Briefly, the grinding machine has a frame and a grinding head mounted thereon to be vertically adjustable about the first vertical axis, as well as to be rotatable with respect thereto. The grinding head includes a first grinding spindle and a workpiece carrier which is carried on a cross slide movable in two horizontal transverse direction, for example an X and a Z axis. The tool to be sharpened is mounted on the workpiece carrier on the cross slide, and additionally is rotatable by a spindle about its now axis; further, the tool carrier is rotatable about a vertical axis, parallel to the vertical axis about which the grinding head can be rotated. A control system is provided which provides for sequential operation of the various grinding steps of which the machine is capable.

In accordance with the invention, at least two separately driven grinding spindles are provided, at least one of them having an axis of rotation located in a horizontal plane. At least three separate grinding wheels or grinding disks are located on the at least two separate grinding spindles. The control means control engagement of one selected one of the grinding wheels with the workpiece in dependence on the orientation of the tool which, also, is changed by the control means for subsequent engagement of others of the grinding wheels, so that all the cutting surfaces of the respective tools mounted on the workpiece carrier can be sharpened.

The machine has the advantage that all types of grinding and/or sharpening operations which occur in rotatable cutting tools can be carried out thereby. This is made possible by providing the at least three grinding wheels on the tools. The respective grinding spindles which carry the grinding wheels or disks can be suitably adjusted or controlled, without requiring an extensive number of axis of movement for the machine, and the machine positioning heads. Thus, the control of the machine, its programming, as well as the mechanical construction thereof is simplified and the overall machine can be made more economically than prior art apparatus. The machine requires only six axes of movement, of which three have rotation associated therewith and three have translatory movement associated therewith.

Each one of the grinding wheels may have its own grinding spindle associated therewith; it is also possible, however, to so construct the machine that a horizontal grinding spindle carries two grinding wheels, one at each end. Likewise, the grinding spindle which is pivotable in a vertical plane and about a horizontal axis also may have two grinding disks positioned at each end. Since the first grinding spindle with its axis can be tipped from a vertical position, and at least a further grinding spindle with its axis in essentially horizontal position is provided, the two grinding spindles will cross, in space, when located in their starting position. Consequently, the positioning movement from the starting positions will be small in order to move the respective spindles and hence the cutting or grinding wheels in the appropriate position, in space for working on the machine tool.

The machine has the additional advantage that standard commercial grinding disks or wheels can be used; no specially constructed or formed grinding wheels are required. This substantially improves the economics of operation of the machine, since just those very items which wear, and require replacement, can be standard articles of commerce.

The short or small movements required of the tool carrier as well as of the grinding head, upon transition between sequential working operations reduce the time during which no grinding is carried out; thus, the "dead time" of the machine is short, which also contributes to its economic utility. Such short movements can be obtained when, in accordance with a feature of the invention, the vertical plane within which the first spindle axes is included, and the horizontal spindle is positioned at different sides of the first vertical axis about which the grinding head is rotatable.

In accordance with a preferred feature of the invention, the horizontal grinding spindle is so positioned that it can be tipped about a horizontal axis transverse thereto. This permits grinding of a clearance angle on cylindrical cutter edges of a radial milling machine by inclining a grinding wheel on the spindle by a small angle, in order, for example, of about 10°. The arrangement may, however, be also so made that the first spindle can be tipped with its tipping plane about a horizontal axis, spaced by a certain distance therefrom. This also increases the versatility of the grinding tool and the possibility of providing for further adjusted positions.

The first grinding spindle and/or the horizontal grinding spindle preferably are combined to a common adjustable unit, together with the respective drive motor; the grinding head, itself, preferably is so constructed that it can be rotated or tipped by at least 180° about the first vertical axis.

DRAWINGS:

FIG. 7 illustrates the arrangement of FIG. 5, in top view, when grinding clearance angles; and FIG. 8 illustrates the arrangement of FIG. 5, in top view, when grinding clearance angles in the radial portion of the cutting tool.

Figure 1:
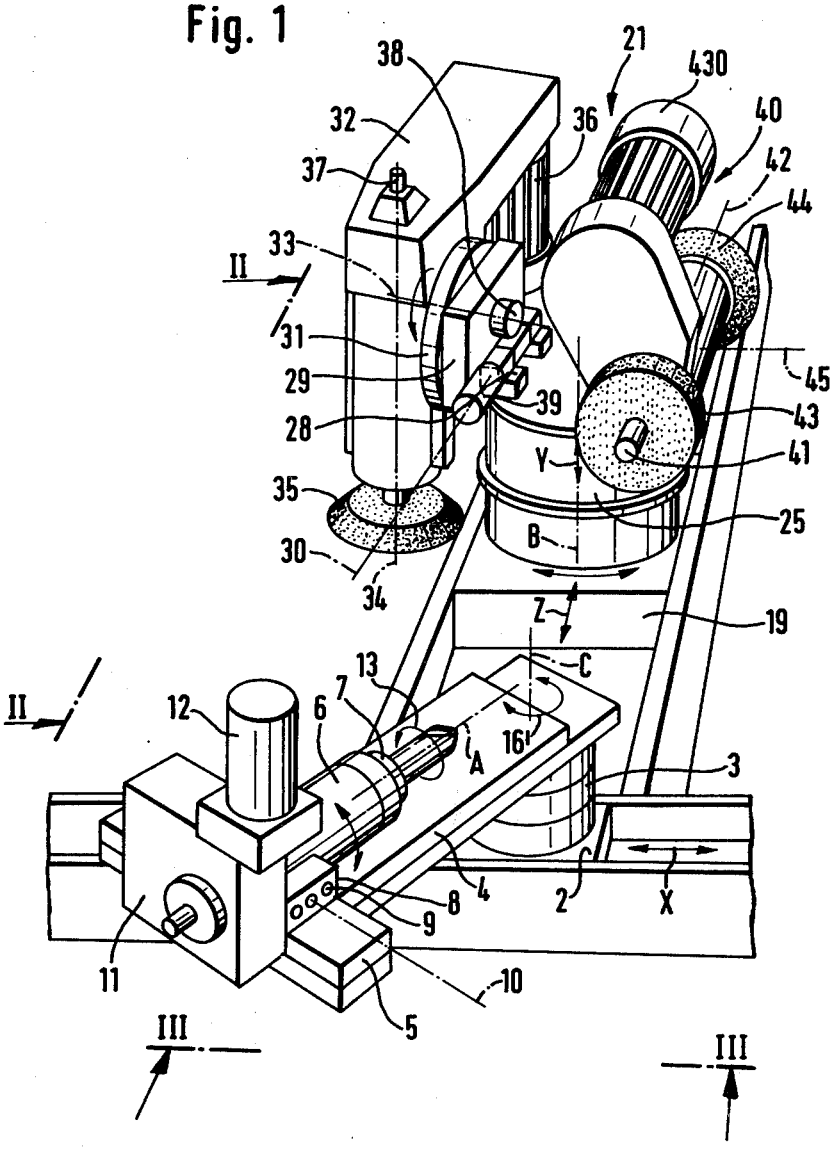
FIG. 1 is a perspective, schematic partial view of the machine.

The program-controlled machine tool has a frame 1 (FIG. 2) on which a first slide 2 is located, horizontally movable along a horizontal axis X. The first slide 2 carries a circular table 3, rotatable about a vertical axis C on which a cross slide is secured with one end, the cross slide having longitudinal and cross supports 4, 5. The cross support 5 carries a spindle housing 6 which is located parallel to the longitudinal support 4. A tool carrying spindle 7 is rotatable in housing 6. The housing 6 is held between two jaws 8 and secured therein by set screws 9. Upon loosening of the set screws 9, the spindle housing 6 can be tipped about a horizontal axis 10, thereby tilting the axis of the spindle 7, which receives the workpiece or tool to be sharpened, by a corresponding tilt angle.

A speed reduction gearing 11 is secured to the spindle housing 6. A drive motor 12, typically a stepping motor, is connected to the speed reduction gearing 11, the drive motor 12 through the speed reduction gearing 11 driving the spindle 7 about its axis of rotation A. Rotation of the workpiece about the axis A is indicated by arrow 13 in FIG. 1.

Similarly, a second stepping motor 15 is associated with the rotating table 3 connected thereto by a speed reduction gearing 14 (see FIG. 2) which permits rotating the table 3 and the cross slide thereon about a vertical axis C, as shown by arrow 16 (FIG. 1). Operation of the motor 15 is program-controlled.

The slide 2 which carries the rotary table 3 is coupled to a program-controlled stepping motor **16*a* (FIGS. 2, 3) in order to move the cross slide 2 in the first horizontal axis X, and with it the cross slide 4, 5 on the table 3, and hence the tool receiving spindle 7, the stepping motor 12, and the associated reduction gearing 11. Stepping motor 16*a*** is program-controlled.

Figure 2:
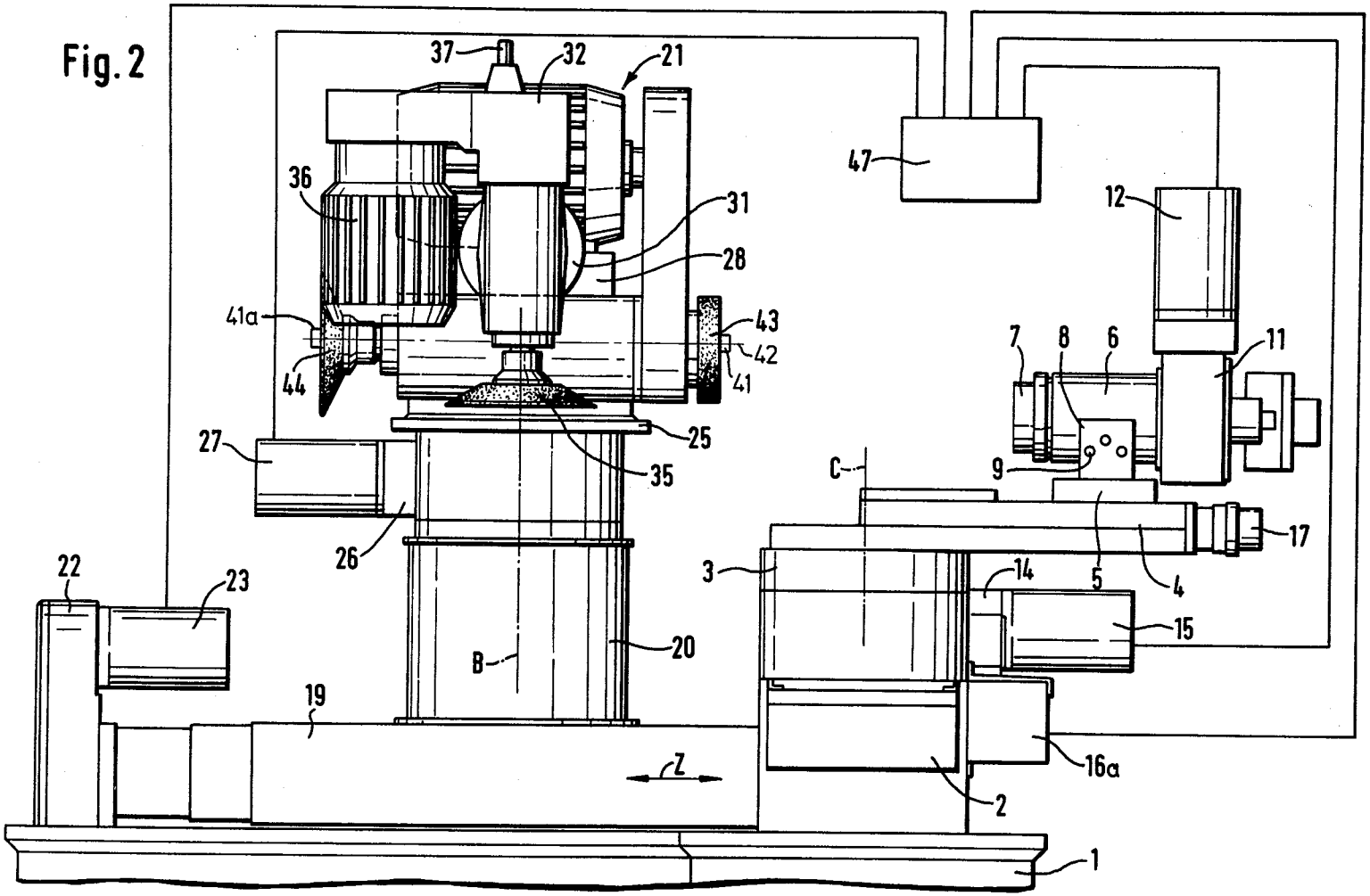
FIG. 2 is a side view taken in the direction of the arrows II—II of FIG. 1, with the workpiece holder stationary.
Figure 4:
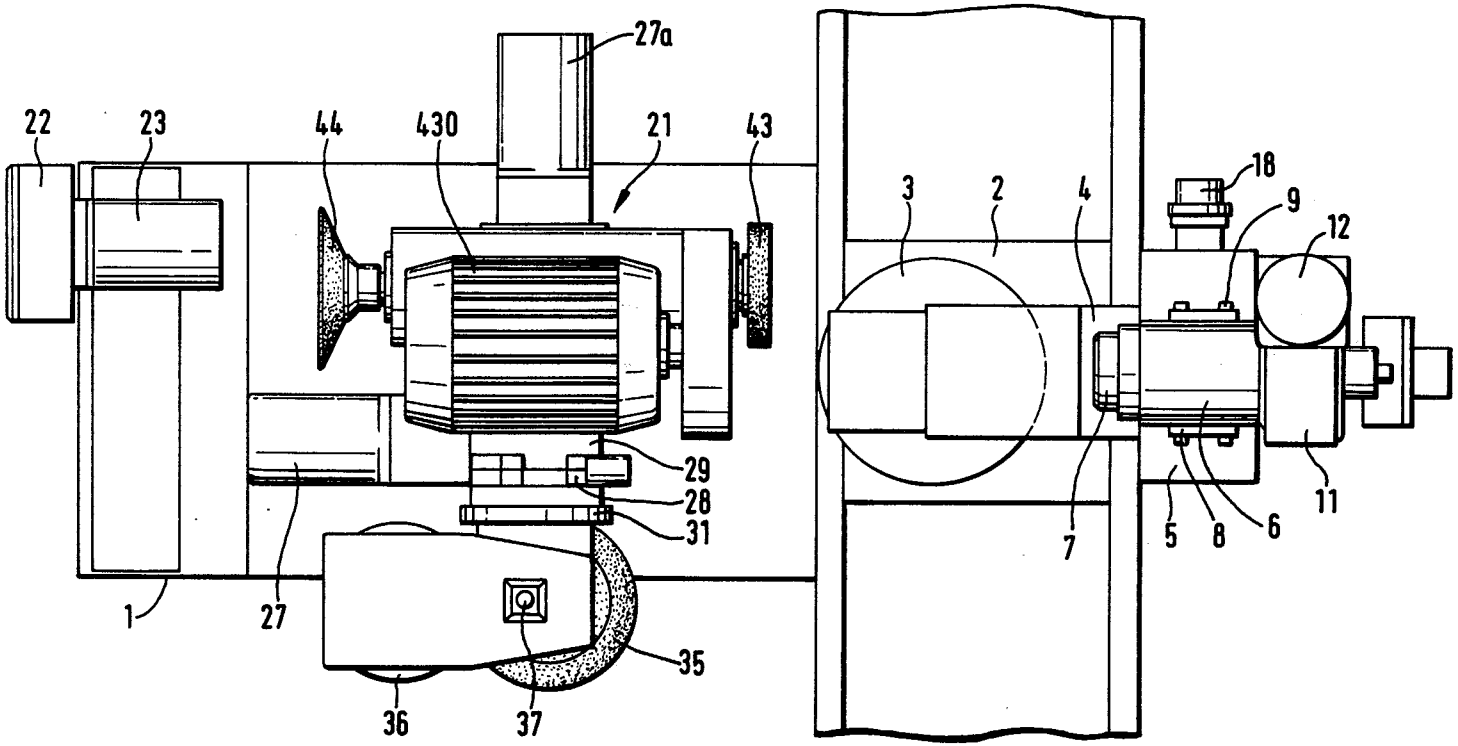
FIG. 4 is a top view of the machine illustrated in FIG. 2.

The longitudinal support 4 of the cross slide can be adjusted manually by operator-controlled movement by a hand wheel 17 (FIG. 2). The transverse support 5 is adjusted by operator-controlled movement by a hand wheel 18 (FIG. 4). Of course, rather than manual, operator-controlled adjustment, the movement of the cross slides in their respective directions can also be controlled electrically, for example by stepping motors, in accordance with program-controlled commands.

Utilizing program-controlled operation of the cross slide by replacing the hand wheels 17, 18 by stepping motors, for example, further reduces the time required for set-up of the machine upon change of workpieces to be ground, at the cost of somewhat increased complexity and automatic positioning apparatus.

A second slide 19 is located on the machine frame 2, movable along an axis Z transverse to the X axis—see FIGS. 1, 2. A column 20 (FIG. 2) is secured to the slide 19, the column 20 being height-adjustable. A grinding head 21 is secured to the column 20. The slide 19 can be moved, under program control, by a stepping motor 23 (FIG. 2) driving a speed reduction gearing 22. Slides 2, 19 form a cross slide.

Height adjustment of the column 20 is along a Y axis (FIG. 3) in accordance with control by a stepping motor 27*a*, flange-connected to a speed reduction gearing 26. The grinding head 21 is rotatably secured to the height-adjustable column 20. The socket 25 of the grinding head 21 can be moved, in two directions, by at least 180° about a vertical axis B (FIGS. 1, 2). FIG. 1 illustrates the standard or stop or rest position from which movement, in either direction, of 180° can be commanded. A holding plate 29 is secured to the socket 25 by support elements 28. The plate 29 carries an attachment surface on which a first grinding head unit 32 is positioned, rotatable about a horizontal axis 33 (FIG. 1). A disk 31 is provided as an intermediate holding element between the plate 29 and the first grinding unit 32.

The first grinding unit 32 has a first grinding spindle 37, on which a first grinding disk 35 is positioned. The first grinding spindle 37 is rotatable about an axis of rotation 34, positioned in a vertical plane and pivotable about the axis 33 (FIG. 1). An electric motor 35 is coupled to the spindle 37. The first spindle 37 may be tipped or tilted or rotated about the horizontal axis 33 out and away from the starting position illustrated in FIG. 1, for example in order to cut or to grind the spiral angle of a workpiece to be ground. A suitable angle of rocking of the spindle about the axis 33 is, for example, ±50°, from the center position illustrated in FIG. 1. Additionally, the entire grinding head 32, if necessary together with the pivoting axis 33 of the axis 34 of the spindle 37, can be pivoted about about the other horizontal axis 30, determined by the holding elements 28 which form pivoting or bearing holders. Both pivoting movement can be done manually; under normal conditions, the two pivoting axes 30, 33 may have stepping motors associated therewith, coupled to suitable reduction gearing, as illustrated schematically in FIG. 1 at 38 and 39.

Figure 3:
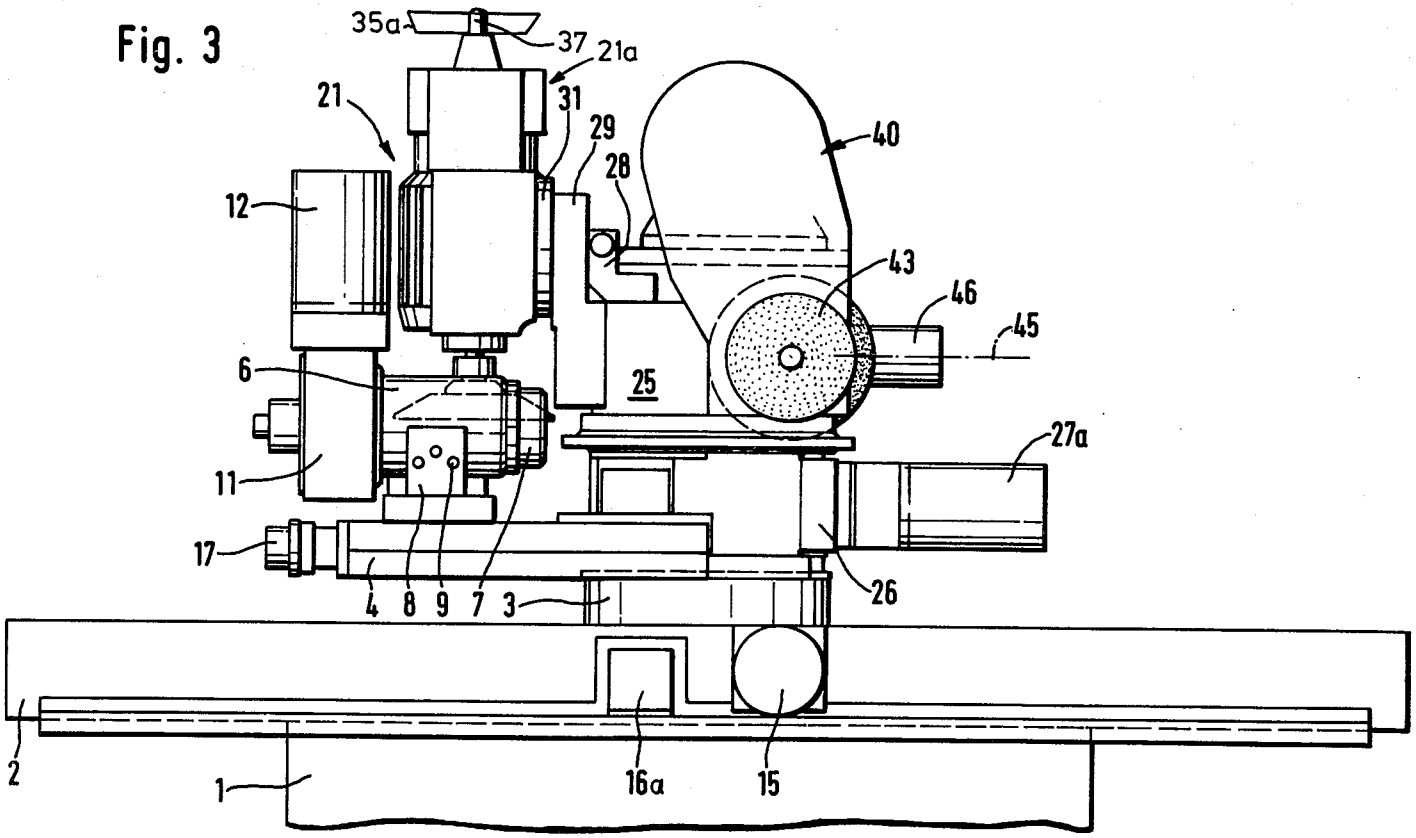
FIG. 3 is a side view in the direction of the arrows III—III of FIG. 1, with the workpiece carrier rotated laterally.

A second grinding head unit 40 is secured to the post 20 opposite—with respect to the vertical axis B—to the grinding head 32. The second grinding head 40 has a second spindle 41, having an axis of rotation 42 (FIG. 1) which is, essentially, in a horizontal plane, and driven by a motor 430 forming part of the grinding head 40. The horizontal grinding spindel 41 carries two grinding disks 43, 44 at its respective ends. One of these, grinding disk 44, is formed with bevelled edges so that, essentially, it is conical. The second grinding head 40 is pivotable about a horizontal axis 45 (FIGS. 1, 3) with respect to socket 25. A pivoting angle of ±10°, starting from the position shown in FIG. 1 or 3, is usually sufficient. This rotation or pivoting movement can be program-controlled and commanded by a stepping motor 46, shown schematically only (FIG. 3).

The structure supported by the post 20 thus carries three grinding disks or grinding wheels 35, 43 and 44. A further, fourth grinding disk can be applied to the spindle 37, for example by attaching a disk at a vertically projecting stub at the top, visible in FIG. 1. Further, the two grinding disks 43, 44 may have individual spindles associated therewith, individually driven. It is a feature of the invention, and essential, that in any event the grinding head 21 has three separate grinding disks, and the entire machine has six axes of movement, which can be program-controlled. Three translatory movemements, associated with the axis X, Y, Z are provided (FIG. 1). The Y axis is related to the up-and-down stroke of column 20 and thus associated with the grinding head 21. Three axis of tilt or swing, A of the workpiece carrier, B of the grinding head, and C of the cross slide, additionally are provided.

Movement along the axis X, Y, Z, as well as about the axes of rotation or swinging, A, B, C, is controlled by a program control unit 47 (FIG. 2). The program control unit 47 may, additionally, also control the further movement of stepping motors 28, 38, 46 and, further, can control similar suitable stepping motors connected to the adjustment knobs 17, 19 (FIGS. 2, 4) above referred to.

Figure 5:
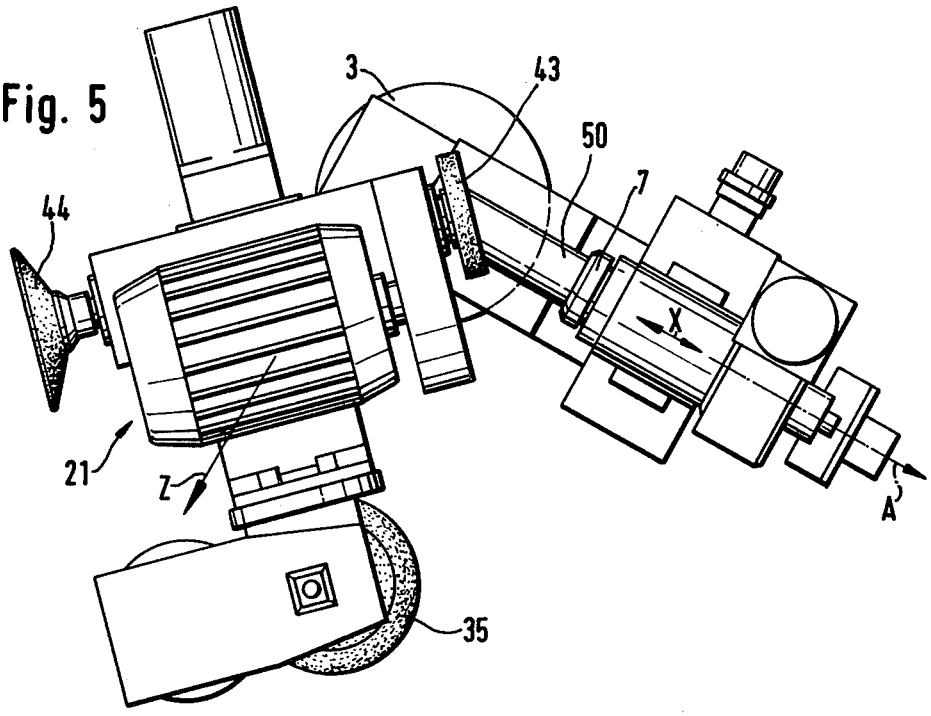
FIG. 5 is a top view of the grinding head of the machine of FIG. 1, illustrating the relative spatial arrangements required when grinding spiral grooves of a spirally grooved tool or workpiece retained in the workpiece holder.

Operation, with reference to FIGS. 5–8: The operation will be illustrated with an example of grinding a boring milling cutter having spiral flutes. Chuck 7 (FIG. 5) is set to receive a cylindrical blank 50. The circular table or turret 3 and the grinding head 21 are angled with respect to each other, as seen in FIG. 5, by the spiral angle of the tool to be made from the blank 50, by displacement about the axes C and X. The grinding wheel 43, which cuts at its circumferential edge (see FIGS. 1, 2) grinds the spiral grooves from the full cylindrical circumference of the blank 50. These grooves are used for chip removal of the finished tool. The blank 50 is suitably rotated about the axis A; the turret 3 is so moved along the longitudinal axis X that a spiral chip removal groove or flute of the required length is ground along the circumference of the blank 50.

Figure 6:
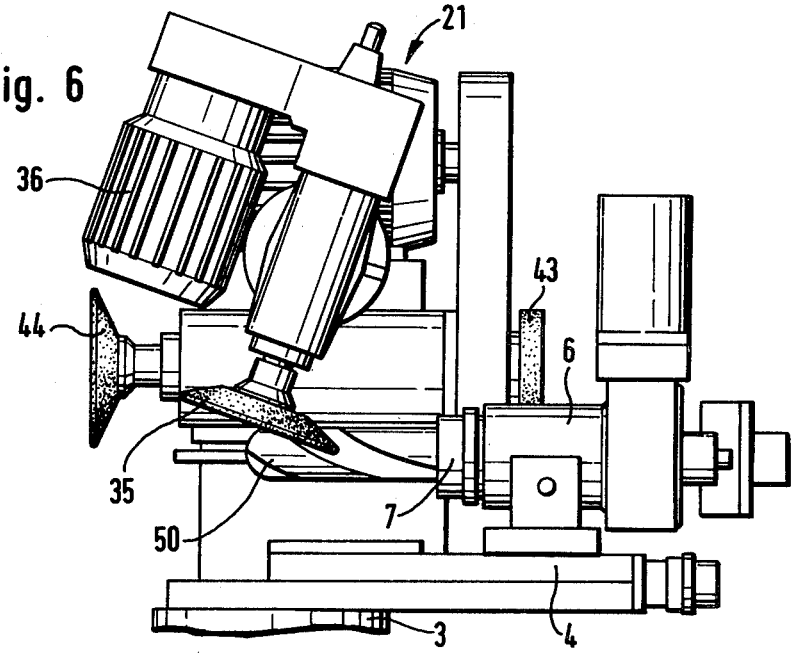
FIG. 6 is a side view of the arrangement of FIG. 5, illustrating the positioning upon grinding of the chip removal surfaces of the tool.

After the grooves have been cut by grinding, the grinding unit 32 and the turret 3 carrying the tool holder are controlled to assume the position shown in FIG. 6. It will be seen that the blank 50 now has become the unit 50', with the spiral grooves already formed therein. In this position, the conical grinding wheel or disk 35 grinds the cutting surface in the cylindrical cutter portion and in the radial portion of the partially made tool 50'. The cutting head or grinding head 32 has been tilted about the horizontal axis 33.

First, the cutting surface is ground on the cylindrical portion of the partly finished tool 50'; upon termination of grinding of the cylidnrical poirtion, the turret 3 is suitably rotated about the axis C to thereby grind, and thus cut, the cutting surface in the radial region.

In the next step, and under program control, the cutting head and the turret 3 are brought in the position shown in FIG. 7. The partially finished cutter, now denoted 50'', will have clearance angles applied thereto by means of the conical grinding disk 44, which applies the clearance angles to the cylindrical portions of the cutting edges. The horizontal spindle can be tilted about the horizontal axis 45 (FIG. 1) by an angle of about 10° with respect to the horizontal (see FIG. 1).

In a final step (see FIG. 8), the clearance angle is applied to the partially finished blank 50''' by movement of the turret 3 about the axis C, back and forth. Thus, the radial clearance angle, in the radial region of the boring mill, is ground.

As is apparent, the blank 50 need be clamped only once in the holder 7. Thus, a substantial decrease in work time is obtained, and further the accuracy of grinding is substantially improved since each repositioning of the blank, and particularly after having been partially worked on, can introduce errors and deviations from desired dimensions. The various movements described can be automatically commanded, controlled by the programming control unit 47 in accordance with a program previously introduced in the programming control unit. Effectively, the programming control unit provides for sequencing and positioning in accordance with well known machine tool programming technology.

The grinding machine of course can be used to grind different types of tools, and can be employed to make practically all rotatable tools; it is particularly suitable for use with tools made of hard metal, or which have hard-metal chips or cutters or inserts applied thereto; and is especially suitable in the manufacture of tools where high precision is required.

Other types of drives than stepping motors may be used, for example d-c servo drives or electro-hydraulic servo drives.

FIG. 2 additionally shows a modification, namely two separate spindles 41, 41*a*, both rotating about the axis of rotation 42. The separate spindles can be driven by separate motors or separately journaled, thereby providing for different speeds of rotation of the respective wheels 43, 44 by separate motor energization, rather than by a single multi-speed motor 430, driving a single spindle 41.

FIG. 3 also illustrates another modification, namely the second grinding wheel 35*a*, located at the upper end of the spindle 37. By rotation of the head 21*a* about the axis 33, the other grinding wheel 35*a* can be brought into operative condition, for example to be used only for finish grinding or sharpening, or the like.

Various changes and modifications may be made within the scope of the inventive concept. We claim:

1. Program-controlled machine tool grinding machine, particularly for the manufacture and sharpening of rotatable cutting tools (13; 50) such as boring tools, drills, milling cutters, and the like, having a frame (1);

a grinding head (21) mounted on the frame and vertically adjustable about a first vertical axis (B), as well as rotatable with respect thereto, said grinding head including a first grinding spindle;

a workpiece carrier (5, 6, 7) to carry a cutting tool (13, 50) to be manufactured or sharpened, including a rotary tool receiving spindle (7) rotatable about a horizontal axis (A);

turret means (3) mounting said workpiece carrier for rotary adjustment about a second vertical axis (C) parallel to said first vertical axis (B);

cross slide means (2, 19) on said frame and providing for support and relative movement of said turret means (3) and said grinding head (21) in two horizontal transverse directions (X, Z);

control means (47) connected to and controlling (a) the respective movements of the grinding head with respect to longitudinal direction, as well as rotation with respect to said axes; and (b) rotation of the tool receiving spindle (7), wherein, in accordance with the invention, at least two separately driven grinding spindles (37, 41) are provided, at least one (41) of said spindles having an axis of rotation (42) located in a horizontal plane (X-Z), and at least three separate grinding wheels (35, 43, 44) are provided, secured to the at least two separate grinding spindles, said control means (47) sequentially controlling engagement of said grinding wheels, one after the other, and controlling the orientation of the workpiece tool (7, 50) with respect to the selected grinding wheel then in grinding engagement with said workpiece tool.

2. Machine according to claim 1, wherein each of said grinding wheels (35, 43, 44) have an individual spindle (41, 41*a*) associated therewith.

3. Machine according to claim 1, wherein one of said grinding spindles is rotatable about adjustable axes of rotation (34) positioned laterally with respect to said first vertical axis (B);

and the other grinding spindle (41) is rotatable about a horizontal axis of rotation (42) positioned laterally with respect to said first axis at a side opposite said first vertical axis (B).

4. Machine according to claim 1, wherein the spindle (41) having the horizontal axis of rotation (42) carries two grinding wheels (43, 44), one on each end thereof.

5. Machine according to claim 1, including grinding head means (40) retaining said spindle (41) having the horizontal axis of rotation, said grinding head means being movably secured for rocking about a horizontal axis (45) transverse to said horizontal axis of rotation (42).

6. Machine according to claim 1, wherein one of said spindles (37) extends in a vertical direction when in a rest position;

grinding head means (32) are provided, retaining said spindle;

and tiltable holding means (28, 29) securing said grinding head means (32) to the gridding head (21) while permitting rocking of said grinding head means, and hence the axis of rotation (34) of said vertical spindle about a horizontal axis (30) positioned laterally with respect to the axis of rotation (34) of said one spindle.

7. Machine according to claim 1, wherein one of said spindles (37) extends in a vertical plane;

and grinding head means (32) are provided, retaining said spindle, said grinding head means being rotatable in said plane to tilt the spindle out of vertical direction.

8. Machine according to claim 1, wherein one of said spindles (37) is positioned in an essentially vertical plane, and two grinding wheels (35, 35*a*) are located on said spindle, one at either end thereof.

9. Machine according to claim 1, including a horizontal grinding head means (40) rotatably retaining said spindle extending in horizontal direction;

a motor (430) for driving said spindle;

a second grinding head means (32) retaining the other one (34) of said spindles;

a motor for driving said other spindle;

and wherein a common support (20, 25) is provided for both said grinding head means, and forming, together therewith, said grinding head (21).

10. Machine according to claim 1, wherein said grinding head is rotatable about said first vertical axis (B) by 180° in either direction from a central or rest position.

11. Machine according to claim 1, wherein at least one of said grinding wheels is a conical grinding wheel; and all said grinding wheels are of standardized shape and dimension.

12. Machine according to claim 1, wherein said grinding head (21) comprises two grinding head means (21*a*, 40), one of said grinding head means retaining and supporting said one spindle (41) having a horizontal axis of rotation, the other grinding head means retaining and supporting the other one (37) of said spindles;

and wherein said cross slide means, and said grinding head, and said grinding head means thereof, are mounted on said frame for movement along three mutually perpendicular axes (X, Y, Z), for translatory movement, and the holding means, the turret means, and said grinding head being additionally movable three axes of rotation (A, B, C), said control means (47) controlling respective movement of said grinding head (21), said grinding head means (32, 40), said cross light slide means (2, 19), and said turret means (3) for relative positioning of the grinding wheels (35, 43, 44) with respect to the workpiece tool (13, 50) by controlling movement along said axes (X, Y, Z, A, B, C).

* * * * *